US007744332B2

(12) United States Patent
Martin

(10) Patent No.: US 7,744,332 B2
(45) Date of Patent: Jun. 29, 2010

(54) SYSTEM FOR STORING AND TEMPORARILY RELOCATING A TRASH CONTAINER

(76) Inventor: Thomas W. Martin, 917 Gabaldon Rd. NW, Albuquerque, NM (US) 87104

( * ) Notice: Subject to any disclaimer, the term of this patent is extended or adjusted under 35 U.S.C. 154(b) by 194 days.

(21) Appl. No.: 11/820,503

(22) Filed: Jun. 21, 2007

(65) Prior Publication Data

US 2008/0314263 A1 Dec. 25, 2008

(51) Int. Cl.
*B65F 3/00* (2006.01)

(52) U.S. Cl. ..... 414/523; 414/340; 414/345; 414/396; 414/400

(58) Field of Classification Search ..... 414/395, 414/396, 398, 400, 809, 345, 222.12, 139.4, 414/139.9, 140.3, 340, 523
See application file for complete search history.

(56) References Cited

U.S. PATENT DOCUMENTS 3,202,305 A * 8/1965 Dempster ..... 414/408
3,561,624 A * 2/1971 Thurmond et al. ..... 414/304
3,625,140 A * 12/1971 Glanz ..... 100/100
3,647,095 A * 3/1972 Smith ..... 414/304
3,719,296 A * 3/1973 Larson, Jr. ..... 414/422
5,092,233 A * 3/1992 Fox ..... 100/38
5,148,739 A * 9/1992 Fox ..... 100/45
5,178,062 A * 1/1993 Spiers ..... 100/269.17
5,405,233 A * 4/1995 Cordell ..... 414/389
5,527,147 A * 6/1996 Hulls ..... 414/809
5,577,873 A * 11/1996 Tanaka et al. ..... 414/400
5,765,986 A * 6/1998 Hulls ..... 414/809
6,418,841 B1 * 7/2002 Little et al. ..... 100/43
6,447,235 B1 * 9/2002 Galeazzi et al. ..... 414/398

* cited by examiner

*Primary Examiner*—Michael S Lowe
(74) *Attorney, Agent, or Firm*—The Adams Law Firm

(57) ABSTRACT

A method and system for storing and temporarily relocating a trash container so as to decongest a thoroughfare.

14 Claims, 5 Drawing Sheets

SYSTEM FOR STORING AND TEMPORARILY RELOCATING A TRASH CONTAINER

BACKGROUND OF THE INVENTION

This invention relates generally to the field of refuse handling apparatus and methods. In a further and more specific aspect, the invention concerns an apparatus and method for storing and temporarily relocating a trash container.

The word "trash" refers to solid waste, garbage, refuse, recyclables or other physical objects and material that is unwanted by the person in possession. The phrase "trash container" means a structure enclosing a space that may be filled with trash, also referred to as a trash bin, refuse collection body, or similar terms. One particular type of a trash container is referred to as a trash "compactor" comprising a body that includes means for forcing loose refuse or trash into a smaller volume of greater density. The term "trash container" includes a standard (non-compaction) container and a compactor type of container. Typically, a trash compactor includes the container and a moving element, such as a piston, for compressing the loose refuse within the container; the piston may be operated by hydraulic fluid under pressure. The hydraulic pressure is produced by a power source such as an electrically operated motor that actuates a hydraulic pump so as to create a high pressure hydraulic fluid. Such power sources for compactor operation are well-known in the art.

In typical commercial refuse collection systems the compactor unit is adapted to be mounted on and transported by a suitable truck that can load and unload the compactor unit. In a typical collection cycle, a compactor unit that is filled to capacity will be loaded onto a truck where the compacted refuse is carried to a suitable refuse collection area, sometimes referred to as a garbage dump, where refuse is deposited and the emptied compactor unit may be taken back to the site where it was picked up or to another site in the event that a different truck had already placed an empty compactor unit at the pick-up site.

Efficient refuse collection requires that the trash container be large enough so as to make each vehicle trip efficient while still staying within the confines of the size of truck bodies that may be permitted on public thoroughfares. The word "thoroughfare" means an alley, street, roadway or other private or public surface for carrying motor vehicle traffic; the term 'thoroughfare level' means an area adjacent a thoroughfare that is at the same level as the thoroughfare and excludes areas below the thoroughfare level, such as a pit within or adjacent the thoroughfare. Thus, a typical trash container of the compactor type may have a width of approximately 10 feet, a height of 10 feet, and a length of between 15 and 25 feet.

The word "system" has its ordinary dictionary definition in this patent: a regularly interacting or interdependent group of items. In the context of the present invention, the system may comprise a trash container, a permanent source of hydraulic pressure, and in at least one of the embodiments of the invention, an opening in a building, including an apparatus for movably supporting a trash container from a storage position to a loading/unloading or temporary "relocated" position.

In urban areas, many city blocks include an alley between two rows of commercial or office buildings that are immediately adjacent the alley providing access to allow moving goods and equipment into and out of a building including, but not limited to, trash. Depending upon the density of the area, many of the buildings may be multi-storied and it is desirable to utilize as large a trash container as laws and regulations will allow because of the volume of trash and the desire to reduce transportation costs to the refuse collection area. Moreover, in many urban areas where alleys exist, the alleys are relatively narrow in width given current vehicle sizes because the alleys were constructed many years ago when vehicle sizes were smaller.

Because of the volume of refuse, and the size of an alley, it is highly desirable that refuse containers be proscribed from storage in any portion of the alley because such presence further creates congestion and inefficiency in collecting refuse as well as accommodating other service vendors who require ingress and egress to the building through the alley. It is also desirable to use a compactor type of refuse container so as to accommodate a large volume of trash by forcibly compressing loose trash into compact high density trash within the container. Accordingly, there is typically provided a high pressure hydraulic system as a source for producing compaction. It is an object of this invention in at least one of its embodiments to utilize the same high pressure source of hydraulic fluid for operating the compactor unit for the power required to move the apparatus for storing and temporarily relocating the compactor unit to facilitate loading/unloading on and from a transport vehicle.

Even in locations where congestion is not as great as in concentrated urban areas, or in areas where alleys are not common, for example in industrial parks, shopping malls, or other commercial or government facilities, it may be desirable to utilize standard or compaction type trash containers of substantial size and for aesthetic reasons, it may be desirable to locate the trash container where its presence is unobtrusive. In such applications, it is still desirable that the large compactor type of trash container be stored in an out-of-the-way location but can be repositioned or relocated to a second location within an alley, street, roadway, or thoroughfare where there is ready, though temporary, access for loading the container onto a refuse collection vehicle as previously described. By enabling the loading/unloading of the trash container in a public thoroughfare, where vehicle access is readily available, the trash depositor need not provide as much space on its private property as would be necessary for maneuvering a large vehicle into loading/unloading position.

It should be understood that the trash compactor units of the rough size described above, when fully loaded, may weigh many tons depending upon the type of refuse that is being collected and whether the container is a standard or compaction type of container. Thus, moving the trash container from a storage location where it is being filled over a period of time, to a loading position that provides ready access to the trash container transport vehicle, is no small task.

In summary, the apparatus and method of the present invention comprises an out-of-way storage location for receiving a trash container during periods of storage, a source of power, and a storage and relocation apparatus supporting the trash container that is moveable from the storage location to a location providing ready access for loading onto, and unloading from, a transportation vehicle.

DETAILED DESCRIPTION OF ONE EMBODIMENT OF THE INVENTION

Figure 1A:
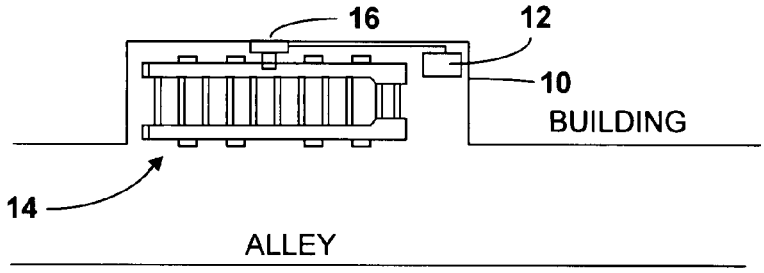
FIGS. 1A through 1E show the method and system of one embodiment of the present invention.

FIGS. 1A through 1E illustrate one embodiment of the method and system for storing and relocating a trash container. As shown, a building located on a vehicle thoroughfare such as an alley, includes an opening or niche or out-of-the-way storage location 10 adjacent the alley or other thoroughfare on which transport vehicles may travel. Within the opening 10, there is a high pressure hydraulic system indicated generally at 12 that serves as a power source for compacting refuse in a compaction type of trash container in one mode of operation and for powering movement of a storage and relocation apparatus indicated generally at 14. The power source 12 is in fluid communication with means for moving the apparatus, that in this specific embodiment, is a hydraulic telescopically extending device 16 fixed at one end within opening 10 and attached at the other end to the storage and relocation apparatus 14. As seen in FIG. 1A, the storage and relocation apparatus is wholly confined within the opening 10. Thus, the storage and relocation apparatus creates no congestion in the alley and permits vehicles to move through the alley without in any way being impeded by the presence of the refuse collection system shown in this embodiment of the invention.

Figure 1B:
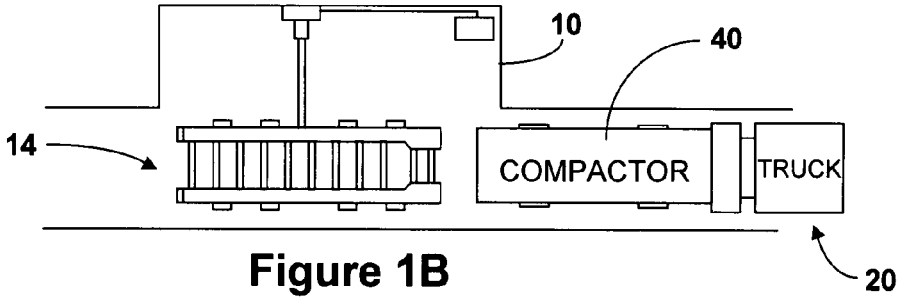

In FIG. 1B, the apparatus 14 has been moved horizontally and laterally out of opening 10 to a position within the alley that provides ready access to a transport vehicle for loading and relocating of a trash container. The transport vehicle in this embodiment comprises a truck 20 (seen best in FIG. 2) on which is mounted a trash container identified as a compactor 40 in FIG. 1B resting on the bed of the elongated chassis of truck 20. As shown in FIG. 1A, the storage and relocation apparatus 14 is empty, that is, it is not supporting a trash container. As seen in FIG. 1B, the truck 20 has delivered a trash container, in the illustrated embodiment comprising a compactor unit 40, of standard industry shape, size, weight and configuration.

The longitudinal axis of the generally rectangular shape of the compactor unit 40 is parallel to the alley. This arrangement is desirable (though not necessary) since if stored orthogonally to the alley, the truck would also be required to be positioned orthogonally to the alley when loading the unit 40 and because of the length of the truck relative to the width of the alley, this may not be feasible as a practical matter. However, in other enclosed areas adjacent a wider thoroughfare, the storage and relocating apparatus may move parallel rather than orthogonal to its axis. Thus the embodiment shown is suitable for use in a narrow alley (the term "narrow" referring to a thoroughfare having one traffic lane or a width that will not permit a transport vehicle to be maneuvered transversely to the thoroughfare) but may be otherwise configured while retaining the same or similar function, that is, movement to and from a storage and a loading/unloading location.

Figure 1C:
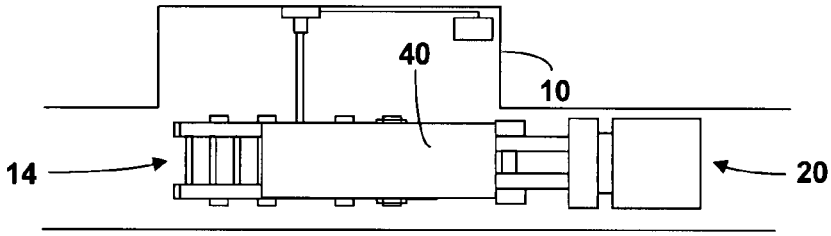

In FIG. 1C, the truck 20 is shown in the process of unloading compactor 40. As appreciated from FIG. 1A, the truck 20 has been aligned with the longitudinal axis of the apparatus 14 and both are preferably centrally located within the alley so that the compactor unit 40 may be guided onto the apparatus 14 as seen best in FIG. 2.

Figure 1D:
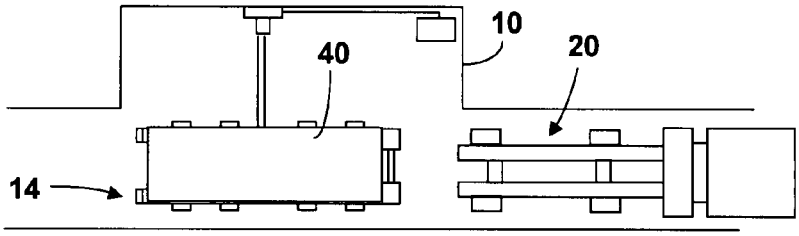

In FIG. 1D, the truck 20 has completed unloading the compactor unit 40 onto storage and relocation apparatus 14. Of course, the compactor unit 40 is empty and has been unloaded to provide a refuse collection point for occupants of the building. The truck 20 is now free to leave the site and continue its regular collection routine.

Figure 1E:
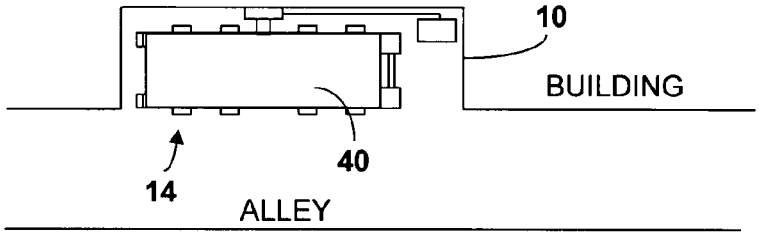

Finally, in FIG. 1E it will be seen that the compactor unit 40, resting on the movable storage and relocation apparatus 14, has been retracted back into the opening 10 in the building and completely out of the way of traffic in the alley.

When the compactor unit 40 is full, so that it is necessary to empty the compactor unit at a refuse collection site, the steps as performed and shown in the embodiment of FIGS. 1A through 1D will be reiterated so that the compactor unit will be loaded onto a truck and taken away to a refuse collection site. Depending upon the arrangement between the building occupants who deposit trash and the provider of the refuse collection services, a second empty compactor unit may be delivered after the first is hauled away, or the compactor unit that is hauled away after it has been emptied at a refuse collection site may be returned to the building.

In summary, the embodiment method comprises locating an apparatus 14 for carrying a trash container in an out-of-the-way location where a hydraulic power system is also located and is connected to the movable container carrying apparatus. Moving the apparatus out of the opening to a second position located in an alley or thoroughfare that is immediately adjacent the out-of-the-way location. Delivering a compactor unit 40 by a transport vehicle 20. Unloading the compactor 40 from the truck 20 onto the apparatus 14. The compactor is empty at the time of unloading from the truck 20. Moving the apparatus 14 on which is mounted the compactor 40 into the out-of-the-way location for a period of time during which occupants of the building deposit trash into the compactor 40. During the time in which the compactor is stored in the out-of-the-way location and is being filled with trash, periodically compacting the trash into a smaller and more dense volume allowing additional trash to be deposited in the compactor. Summoning, when the compactor 40 is filled with compressed trash, the trash collection transport vehicle. Upon arrival of the compactor transport vehicle, moving the apparatus 14 from the out-of-the-way location in the building to a position centrally located in the alley or thoroughfare. Moving the transport vehicle 20 adjacent the apparatus 14 and loading the compactor 40 onto the truck 20. Transporting the compactor unit to a trash collection area where it is emptied. Delivering the empty compactor to the building location. Moving apparatus 14 into the thoroughfare and unloading the empty compactor from the vehicle 20 onto the apparatus. Moving the apparatus from the alley location back into the out-of-the-way location. The transport vehicle is then free to perform other trash collection operations. This cycle is repeated each time the compactor unit is filled with compressed trash.

Figure 2:
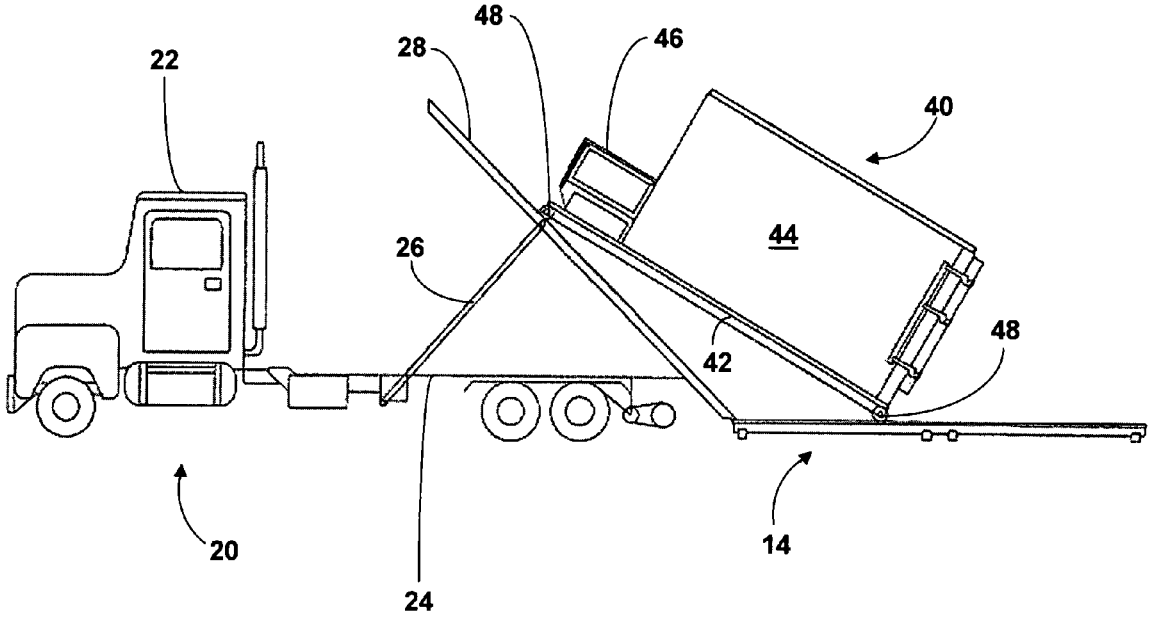
FIG. 2 is a typical transportation vehicle for pick up and delivery of trash containers showing the storage and relocation system in accordance with one embodiment of the present invention.

There is shown in FIG. 2 a typical truck 20 consisting of a semi-trailer cab 22 and an elongated frame 24. A hoist mechanism comprises a first member 26 that is attached at one end to the frame 24 and at the opposite end to a pair of slides 28. Members 26 may be hydraulically pivoted such that members 28 will be moved to a position approximately 45 degrees to the ground while at the same time the lower edge 30 of the side members 28 rests upon the ground, or as in the case shown in FIG. 2, on one end of the storage and relocation apparatus 14, as shown.

The compactor unit 40 may be loaded and unloaded onto and from the frame 42. Unit 40 comprises a body 44 into which refuse is placed. At the forward end of compactor unit 40 is the hydraulic compression apparatus 56 for compressing the loose refuse within the body 44 into a smaller and more dense volume. In operation, when the slide members 28 of the truck 20 are moved to the position as shown in FIG. 2, the compactor unit 40 will move rearwardly until the rear portion of the body 44 and the wheels 48 rest upon the ground, or in the case of FIG. 2, on the storage and transport apparatus 14. The compactor unit 40 may be loaded on to the truck 20 in a variety of ways such as by a cable that pulls the compactor unit 40 up the slide members 28 and then by lowering the slide members 28 to a horizontal position whereupon the compactor unit 40 will be drawn on to the full length of the slide members 28 until the hydraulic compression apparatus 46 is adjacent the cab 22 of the truck 20.

The truck and compactor unit described above is typical of such equipment used in the waste collection industry. A typical truck is shown in FIG. 13 of U.S. Pat. No. 6,183,185.

Figure 3:
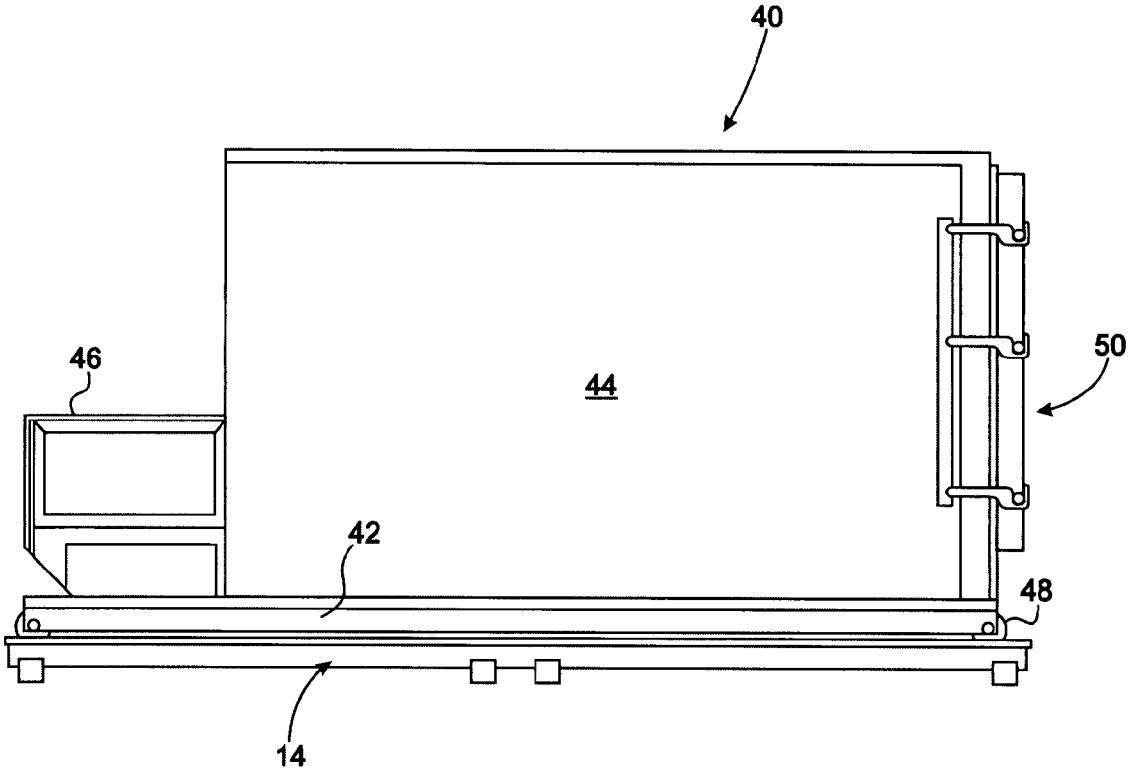
FIG. 3 shows a trash container resting on one embodiment of a storage and relocation apparatus in accordance with the invention.

In FIG. 3, the compactor unit 40 is shown in greater detail positioned on the storage and relocation apparatus 14. The length of the storage and relocation apparatus 14 is approximately equal to the length of the compactor unit 40, although it will be appreciated that the apparatus 14 may be longer or shorter than the compactor unit 40. The compactor unit has a discharge gate indicated generally at 50 at the rear end of the body 44. Typical compactor units have a variety of loading and discharging doors or gates 50 depending on a variety of refuse collection site structures and arrangements.

Figure 5:
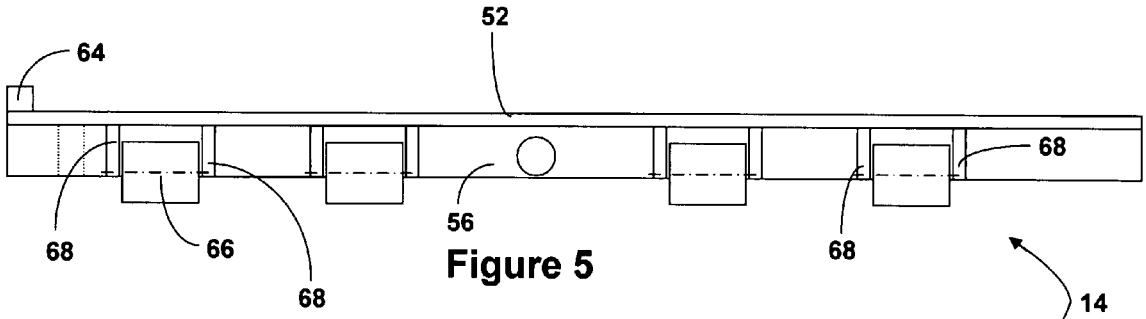
FIG. 5 is a side view of FIG. 4.
Figure 4:
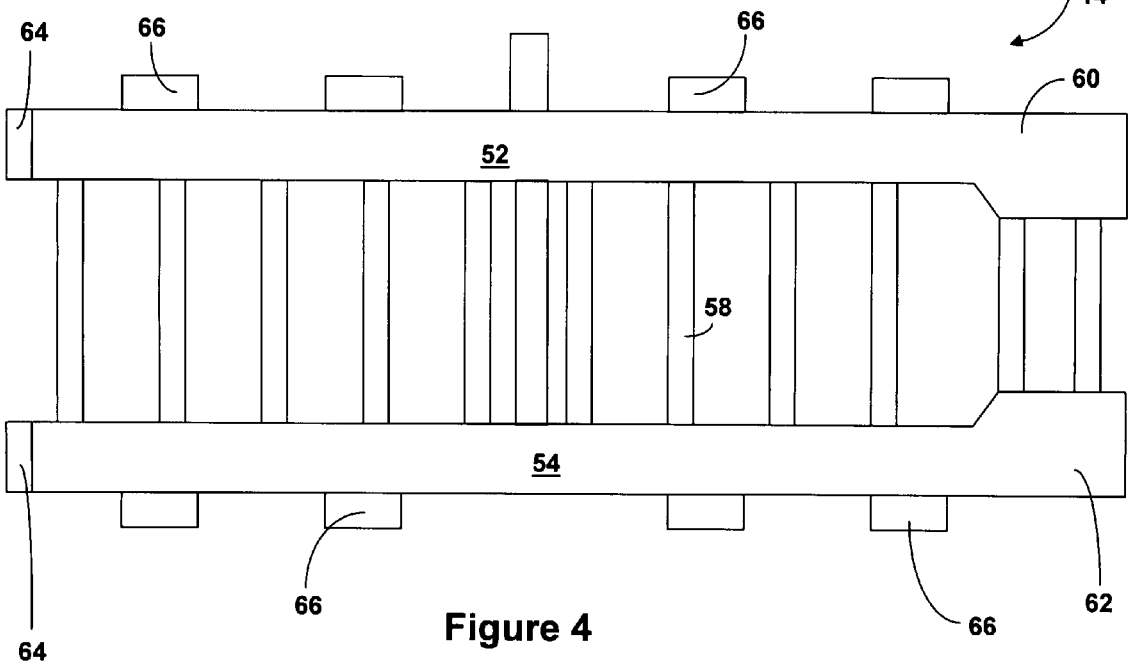
FIG. 4 shows a storage and relocation apparatus in accordance with one embodiment of the invention.

FIGS. 4 and 5 illustrate one embodiment of a storage and relocation apparatus 14. Referring to FIG. 4, it will be seen that the apparatus 14 comprises two elongated flat tracks or runners 52, 54. The runners are connected to a longitudinally extending rail 56 as shown in FIG. 5. The two spaced apart rails underlying the tracks 52, 54 are connected by a plurality of stringers 58. Tracks 52, 54 have a first end in which the tracks are widened at 60, 62 so as to more easily accommodate the wheels 48 on the compactor unit 40 when the compactor unit is being lowered onto the storage and relocation apparatus 14. At the opposite end of tracks 52, 54 are stops 64 to prevent the compactor unit 40 from overrunning the far end of the track as the compactor unit 40 is being unloaded onto the tracks. If desired, the tracks 52, 54 may be provided with elongated lips or sidewalls along their entire length to provide guides for the wheels 48. Those skilled in the art will understand that other structure or tracks 52, 54 may be used to guide the wheels 48 of the compactor unit along the tracks.

Figure 6:
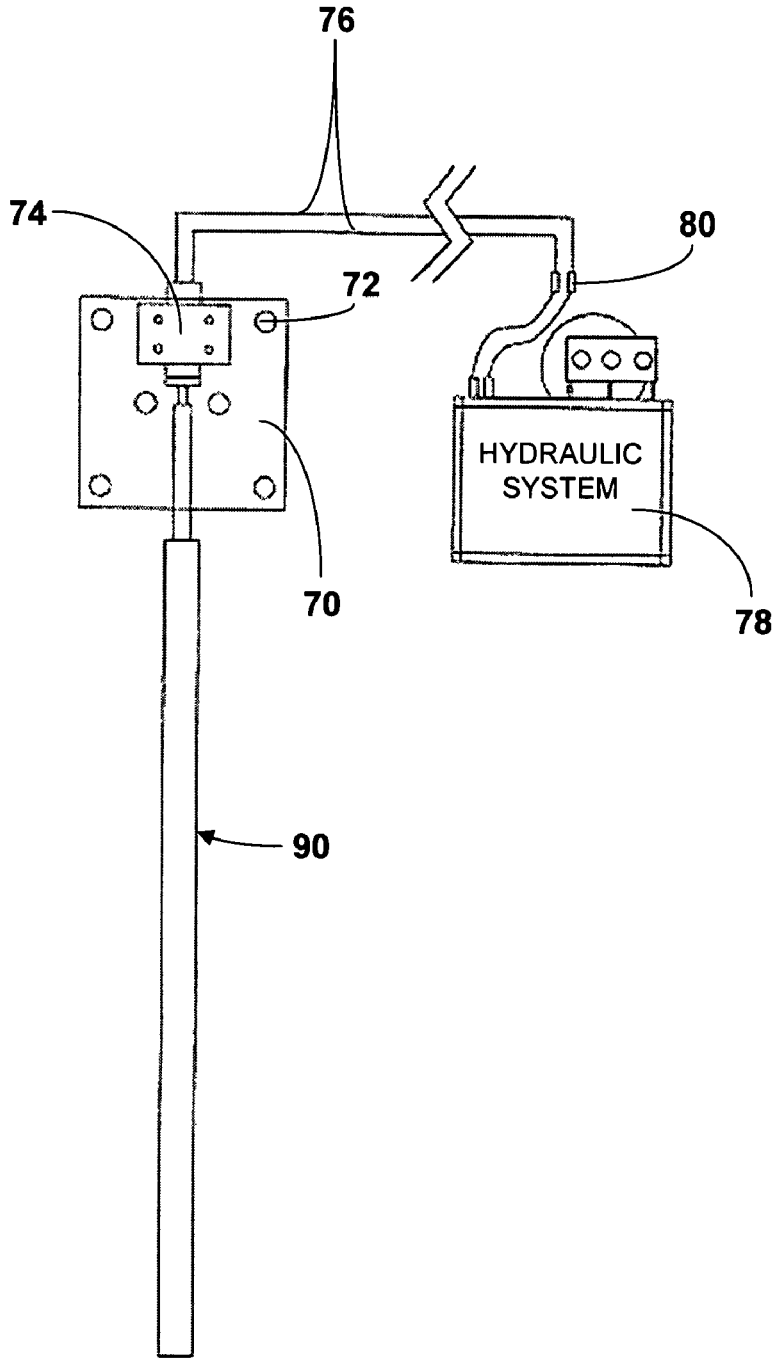
FIG. 6 is a diagrammatic illustration of one embodiment of a power source for operating the storage and relocation apparatus.

The storage and relocation apparatus 14 is provided with a row of wheels 66 mounted on rails 56 through axles (not shown) that are supported in trunnions 68 welded to rails 56 and/or tracks 52, 54. As seen best in FIGS. 4-6, the storage and relocation apparatus 14 is moved from the storage position to the loading/unloading (relocated) position by means of a three-stage telescoping hydraulic cylinder device. As seen in FIG. 4, the last stage of the telescoping hydraulic device passes through the rail 56 closest to the rear wall of the opening in the building and is attached at the rail 56 on the other side of the apparatus 14. As seen best in FIG. 6, the hydraulic device comprises the plate 70 affixed to the floor of the opening through fasteners such as 72. A hydraulic chamber 74 is connected through hydraulic lines 76 that are connected to a hydraulic high pressure system 78 through quick disconnect connectors 80. As noted above, the hydraulic system 78 is equipment that is typically provided for use with a compactor unit to power the compression of the trash into a more confined volume. As such, it is typically installed for the compactor supplier; this embodiment of the invention utilizes the installed hydraulic system and thereby reduces the cost of the storage and relocation system. By disconnecting the lines 76 from the compactor compression apparatus 46 and reconnecting these lines to the hydraulic chamber 74, the high pressure hydraulic fluid can be used to extend the telescoping sections 90 such as the sections shown in FIG. 6.

The present invention has been described above with reference to one embodiment. However, those skilled in the art will recognize that changes and modifications may be made in the described embodiment without departing from the nature and scope of the present invention. For example, the subsystem for moving the apparatus 14 into and out of the opening 10 could utilize various mechanical arrangements that fold and unfold such as articulated, jointed arms that extend and collapse. Alternatively, a fixed screw actuator, electrically driven, could be used to move the apparatus 14 and could be withdrawn into an opening at the wall of the opening 10 and into the internal portion of the building when the apparatus 14 is in the storage position. In addition to pushing mechanisms, by providing a suitable track into the alley, the apparatus 14 could be pulled into the center of the alley by cables powered either electrically or hydraulically. The apparatus wheels could be driven through various power sources, rather than passive. The apparatus 14 is shown in the embodiment as moving on wheels but other alternatives may be used such as steel skids or the unit may move on stationary tracks that extend into the alley but below the road surface. Of course, although the wheels are shown as steel cylinders, they could be made of various materials such as rubber or inflated tires. Other modifications to the embodiment herein chosen for purposes of illustration will readily occur to those skilled in the art. To the extent that such modifications and variations do not depart from the spirit of the invention, they are intended to be included within the scope thereof which is assessed only by a fair interpretation of the following claims.

I claim:

1. A system for storing and temporarily relocating a trash container having a rectangular shape from an out-of-the-way storage location to a ground level thoroughfare location so as to relieve congestion in the thoroughfare immediately adjacent the storage location, comprising:

an immobile thoroughfare level storage location for receiving said trash container;

a movable apparatus having a rectangular shape and generally the same size as the container on which the trash container may be mounted, said apparatus located in the storage location with the longitudinal axis parallel to the thoroughfare and a normal direction of travel of traffic thereon; and means for moving said apparatus transversely relative to the normal direction of traffic along the thoroughfare to a temporary location in the thoroughfare and keeping said apparatus in constant contact with the ground level of either the thoroughfare or storage location thereby providing access for loading/unloading the container onto or from a vehicle for transportation to and from a refuse collection area and retracting the apparatus back to the storage location.

2. The system of claim 1 additionally comprising means for movably supporting the apparatus and container.

3. The system of claim 2 wherein said means for movably supporting the apparatus and container is selected from the group comprising wheels, rollers, skids, tracks and other low friction devices.

4. The system of claim 1 wherein the trash container is a trash compactor.

5. The system of claim 4 additionally including a power source for said means for moving said apparatus from a storage to a thoroughfare location.

6. The system of claim 5 wherein said power source is hydraulic.

7. The system of claim 6 wherein the hydraulic system also powers the trash compactor.

8. The system of claim 1 wherein said means for moving said apparatus comprises a multi-section telescoping device attached at one end within the storage location and attached at the opposite end to the movable apparatus on which the trash container is mounted, whereby the telescopic sections may be extended and retracted so as to relocate the position of the apparatus and container.

9. The apparatus of claim 8 wherein said apparatus includes a frame having two tracks for receiving and supporting the compactor on the apparatus.

10. A trash handling system for storing a trash container in an elongated ground level opening adjacent, parallel and at the same level as a thoroughfare and temporarily relocating the container into the thoroughfare for loading/unloading onto a truck, the container having an elongated shape and adapted for loading/unloading onto a truck bed by means of wheels mounted on the container bottom that permits the container to roll along its longitudinal axis of a normal direction of travel on the thoroughfare, comprising:

a storage and relocation structure including two parallel, spaced apart tracks, configured and adapted for receiving the wheels mounted on the container, such structure of substantially the same size and shape as the container, low-friction devices selected from the group comprising wheels, rollers, skids and tracks mounted on the bottom of said structure and in constant contact with said ground level; and an extendible apparatus for moving said structure transversely to its longitudinal axis which is substantially parallel with the normal direction of travel along the thoroughfare from the storage location to a position within the thoroughfare so that the longitudinal axis of the truck and container are generally parallel and aligned to allow loading and unloading of the container on to the truck.

11. The system of claim 10 wherein the extendible apparatus for moving said storage and relocation structure transversely to its longitudinal axis comprises a telescoping hydraulically-driven apparatus.

12. The apparatus of claim 11 additionally including a hydraulic power source located in the opening.

13. The apparatus of claim 12 wherein the container is a compactor.

14. The apparatus of claim 13 wherein the hydraulic power source is configured and adapted for operating the compactor and operating the telescoping apparatus.

* * * * *